United States Patent [19]

Blanning et al.

[11] 4,277,039

[45] Jul. 7, 1981

[54] METHOD AND SYSTEM FOR INDUCING AND CONTROLLING NUTATION OF A GYROSCOPE

[75] Inventors: Robert B. Blanning, Orlando; Archie B. Treadwell, Winter Park; James A. Logie, Orlando, all of Fla.

[73] Assignee: Martin Marietta Corporation, Orlando, Fla.

[21] Appl. No.: 880,210

[22] Filed: Feb. 22, 1978

[51] Int. Cl.[3] ..... F41G 7/26; G01C 19/54

[52] U.S. Cl. ..... 244/3.16; 74/5.4

[58] Field of Search ..... 244/3.16; 350/6.6; 250/203, 342; 74/5.22, 5.4, 5.47, 5.7

[56] References Cited

U.S. PATENT DOCUMENTS

| | | | |
|---|---|---|---|
| 1,650,280 | 11/1927 | Koenig | 74/5.4 |
| 3,009,152 | 11/1961 | Gregory et al. | 74/5.22 |
| 3,320,818 | 5/1967 | Magnus | 74/5.4 |
| 3,733,133 | 5/1973 | Chapman | 244/3.16 |
| 3,805,625 | 2/1973 | Schlitt | 74/5.4 |
| 3,971,939 | 7/1976 | Andressen | 244/3.16 |
| 4,036,453 | 7/1977 | Evans et al. | 74/5.4 |

*Primary Examiner*—Charles T. Jordan

*Attorney, Agent, or Firm*—Julian C. Renfro; Gay Chin

[57] ABSTRACT

A method and system for inducing and controlling nutation of a gyroscope momentum wheel (or member) so that such controlled nutation can be used for purposes such as target searching, acquisition and tracking, particularly in a guided missile system. A nutation command signal having a frequency integrally related to the natural nutation frequency of the gyroscope momentum member is generated, preferably is response to a momentum member position feedback signal. The generated nutation command signal is applied to a torquer to induce movement of the momentum member at the frequency of the nutation command signal. The amplitude of the nutation command signal is selectively controlled to control the amplitude of the induced movement and thereby control the movement of the momentum member through a desired pattern. In the disclosed embodiment, the momentum member controls the line-of-sight of a sensor such as a light or other electromagnetic wave energy detector. The controlled nutation of the gyroscope momentum member provides, in such an arrangement, both desired low frequency signals relating to long term sensor movement (e.g. tracking information) and high frequency signals relating to short term sensor movement (e.g. search or other scan related information).

32 Claims, 10 Drawing Figures

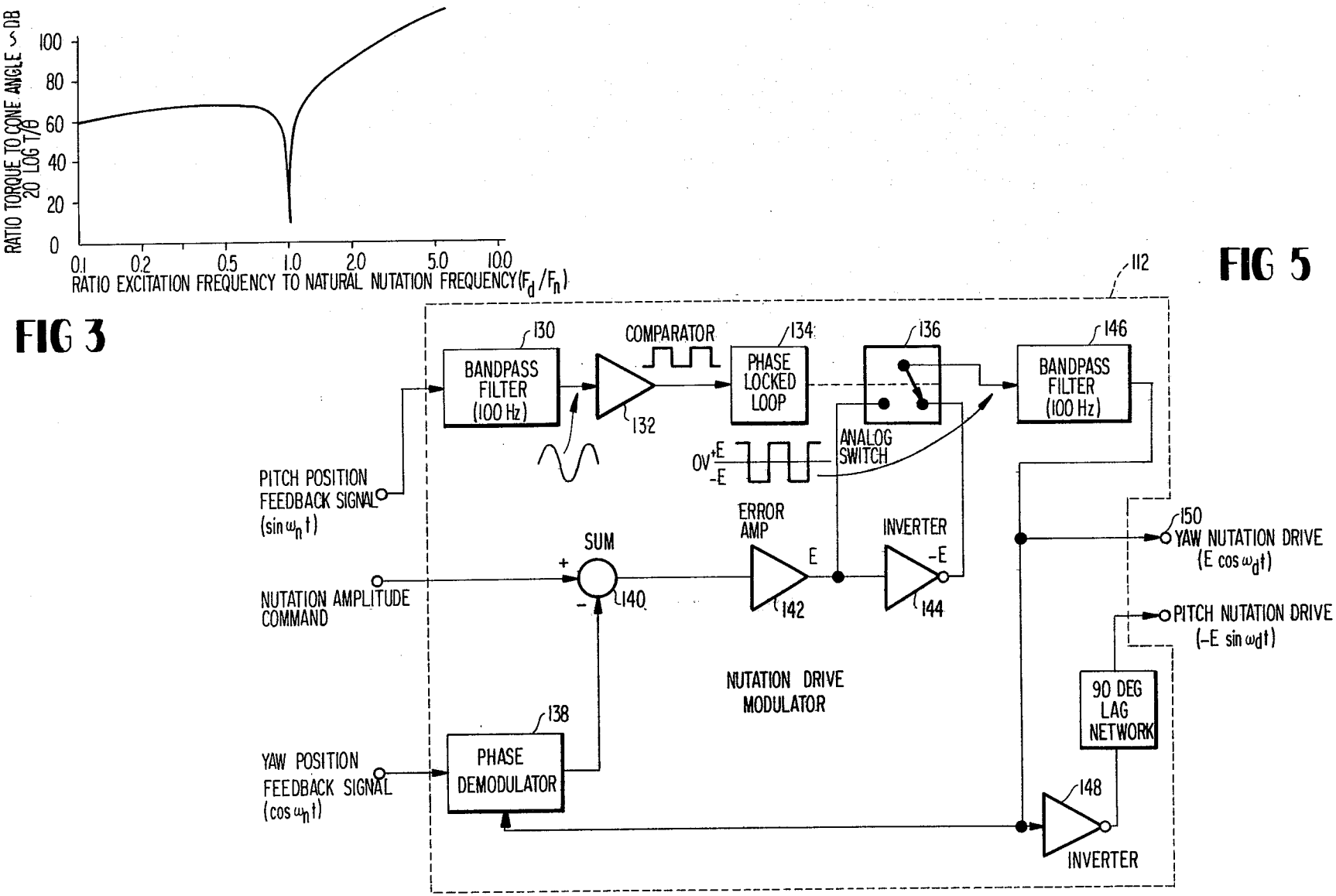
FIG 5
112
BANDPASS FILTER (100 Hz)
130
COMPARATOR
132
PHASE LOCKED LOOP
134
ANALOG SWITCH
136
BANDPASS FILTER (100 Hz)
146
PITCH POSITION FEEDBACK SIGNAL ($\sin \omega_n t$)
NUTATION AMPLITUDE COMMAND
YAW POSITION FEEDBACK SIGNAL ($\cos \omega_n t$)
SUM
140
ERROR AMP
142
INVERTER
144
PHASE DEMODULATOR
138
90 DEG LAG NETWORK
INVERTER
148
NUTATION DRIVE MODULATOR
150
YAW NUTATION DRIVE ($E \cos \omega_d t$)
PITCH NUTATION DRIVE ($-E \sin \omega_d t$)
FIG 3
RATIO TORQUE TO CONE ANGLE ζ DB
20 LOG T/θ
RATIO EXCITATION FREQUENCY TO NATURAL NUTATION FREQUENCY ($F_d/F_n$)

METHOD AND SYSTEM FOR INDUCING AND CONTROLLING NUTATION OF A GYROSCOPE

BACKGROUND OF THE INVENTION

The present invention relates to space stabilized scanning systems for target tracking, missile guidance and the like. The invention in particular relates to a method and system for scanning an area of interest with a sensor that is referenced to a space stabilized reference member such as a gyroscope momentum wheel or member.

In weapons system or other systems that require the locating and/or tracking of an object such as a target, a sensor or detector is usually employed to sense energy (e.g. light, heat, radio frequency radiation, etc) received either directly or by reflection from the object. The sensor is typically arranged to produce an electrical signal related to the magnitude of the energy received from a particular direction. In this manner, a sensor line-of-sight is established, and movement of this line-of-sight can be controlled for purposes such as acquiring and tracking targets. When tracking an object, for example, the system can produce, and use for position control purposes, an error signal representing the amount and direction of difference between the sensor line-of-sight and the object line-of-sight (i.e. the line-of-sight between the sensor and the object being tracked).

In order to produce error signals that are useful for tracking and guidance in systems such as missile guidance system where the structural frame of reference is constantly moving, a space stabilized reference for the sensor line-of-sight is usually provided. The space stabilized reference is often provided in such systems by a gyroscope which includes a spinning mass. The spinning mass is referred to herein as a momentum wheel or member and is referred to as part of the gyroscope although it should be understood that it is not uncommon to refer to the spinning mass itself as a gyroscope. The momentum member is typically supported on a multi-degree of freedom gimbal system such that it provides a space stabilized platform to which the sensor or detector line-of-sight may be referenced.

By way of specific example, a sensor may be mounted in such a system so as to provide signals related to the amount of electromagnetic wave energy (e.g. infrared, laser visual, radio frequency, etc.) received by the sensor from a direction having a predetermined orientation with respect to the spin axis of the gyroscope. The sensor may be mounted on the gyroscope in selective alignment with the spin axis to accomplish this purpose, or an optical system mounted on the gyroscope may be arranged to direct, to the sensor, energy received along the spin axis. In either arrangement, the sensor line-of-sight is somehow referenced to the gyroscope spin axis and the magnitude of the signal produced by the sensor will be related to the position of the spin axis of the gyroscope relative to the object from which the wave energy is received. Thus, there is a space stabilized reference for the sensor.

With any multi-degree of freedom spinning mass there is an inherent instability that causes the mass to nutate, i.e. causes the spin axis to revolve or "wobble" about a fixed spatial axis. In a tracking system of the type previously used to generate guidance commands for a missile, such nutation has been considered undesirable, and mechanical dampers are typically provided to introduce a dampening effect on the natural nutation. It will be appreciated that if the spinning mass nutates in an uncontrolled manner, the stabilized space reference for the sensor line-of-sight is lost and accurate tracking or other control functions cannot be maintained.

In various modes of system operation, e.g. searching, acquisition or tracking, certain controlled movement of the sensor line-of-sight may be desirable or even required. It has therefore been common to maintain the gyroscope spinning mass in a stabilized position with the aforementioned mechanical dampers and to move the optical system or the sensor relative to the gyroscope spin axis in some predetermined manner in order to obtain a desired pattern of sensor line-of-sight movement, e.g. a scanning pattern for target acquisition or tracking.

If the scanning pattern must be varied in a precisely controlled manner then this method of obtaining a desired scanning pattern requires complex mechanisms and may introduce inaccuracies because of the required relative movement (and resultant mechanical coupling) between these mechanism. Complexity, of course, leads not only to increased cost and decreased reliability, but more importantly, it can also result in increased size and weight, two factors that are extremely important in weapons systems.

It is thus an object of the present invention to provide a novel method and a space stabilized scanning system that overcomes the foregoing and other problems associated with prior art system.

Another object of the present invention is to provide a stable system for inducing and controlling gyroscopic nutation to serve a useful purpose. A novel method and system has been devised as a part of the invention for excitation and control of gyro-mechanical instability. A fixed amplitude excitation at the natural nutation frequency of a spinning mass is introduced to cause nutation in the pitch and yaw axes. In the absence of a negative rate feedback signal maximum circular nutation, with rates measured in thousands of degrees per second, is obtained. Nutation control is obtained by comparing the amplitudes of the rate feedback and nutation command signals and apply a torque to reduce the difference to zero. Differential variation in the amplitude of the nutation command signals is used to control the eccentricity and pattern of nutation achieved, thereby permitting generation of not only circular or elliptical patterns, but also more complex patterns such as rosettes, etc. The gyroscopic excitation and control mechanism according to the invention may be electrical, electronic mechanical, pneumatic, hydraulic, fluid or any combination of the foregoing implementations.

Yet another object of the present invention is to devise a means of controlling the frequency of nutation excitation of a momentum wheel to maintain correspondence with the natural resonant frequency of momentum wheel nutation which continuously varies as the spin rate of the wheel changes. To minimize torque excitation requirements and therefore power input requirements, the ratio of the nutation excitation frequency to the natural nutation frequency must be maintained within sharp null limits very close to one. A difficulty encountered in maintaining a one to one frequency ratio is that the natural nutation frequency varies in direct proportion to changes in spin rate.

A novel method and system for maintaining a one-to-one frequency relationship between excitation torque and the natural resonance is embodied according to one aspect of the invention in a control system which maintains a fixed phase relationship between a gimbal axis nutation component obtained as the output of one or both of the pitch or yaw position sensors. A zero or very small phase angle between the position sensor output signal and the excitation torque signal is maintained by increasing or decreasing the torque excitation frequency as commanded by a closed loop system to minimize the relative phase difference between the two signals.

The present invention has, as one of its further objects, the provision of a novel method and system for scanning an area of interest with a sensor through an electronically controlled nutation of a space stabilized momentum member such as the rotor of a gyroscope while retaining the low frequency space stabilization characteristics of the member.

Yet another object of the present invention is the provision of a novel method and system for scanning an area of interest relative to a space stabilized reference member wherein a natural tendency of the stabilized reference member to nutate is utilized advantageously to cause a controlled nutation of the stabilized reference member.

Still another object of the present invention is to provide a novel method and system for scanning an area of interest relative to a space stabilized reference member wherein mechanical nutation dampers are removed from the reference members, a sensor line-of-sight is fixed relative to the reference member and the reference member is caused to nutate in a controlled manner in order to cause the sensor line-of-sight to move in a controlled manner through the area of interest proximate to the target.

An object of the present invention is also to cause a gyro spin axis, through controlled nutation, to cross and re-cross a particular point in space, identifiable to the selected sensor device utilized in the particular application. This high frequency repetitive crossing of the identifiable point may be in any number of geometric patterns such as circles, rosettes, or other scan pattern devised to optimize the sensor response and provide an error signal which is fed back to position the momentum wheel to center the patterns over the selected points to achieve tracking of that point.

These and other objects and advantages of the present invention will become apparent to one skilled in the art to which the invention pertains from the following detailed description when read in conjunction with the appended drawings.

BRIEF DESCRIPTION OF THE DRAWINGS

FIG. 3 is a graph illustrating the torque versus frequency characteristics for nutation of a gyroscope momentum wheel;

FIG. 5 is a functional block diagram illustrating the nutation drive modulator of FIG. 4 in greater detail;

DETAILED DESCRIPTION

Figure 1B:
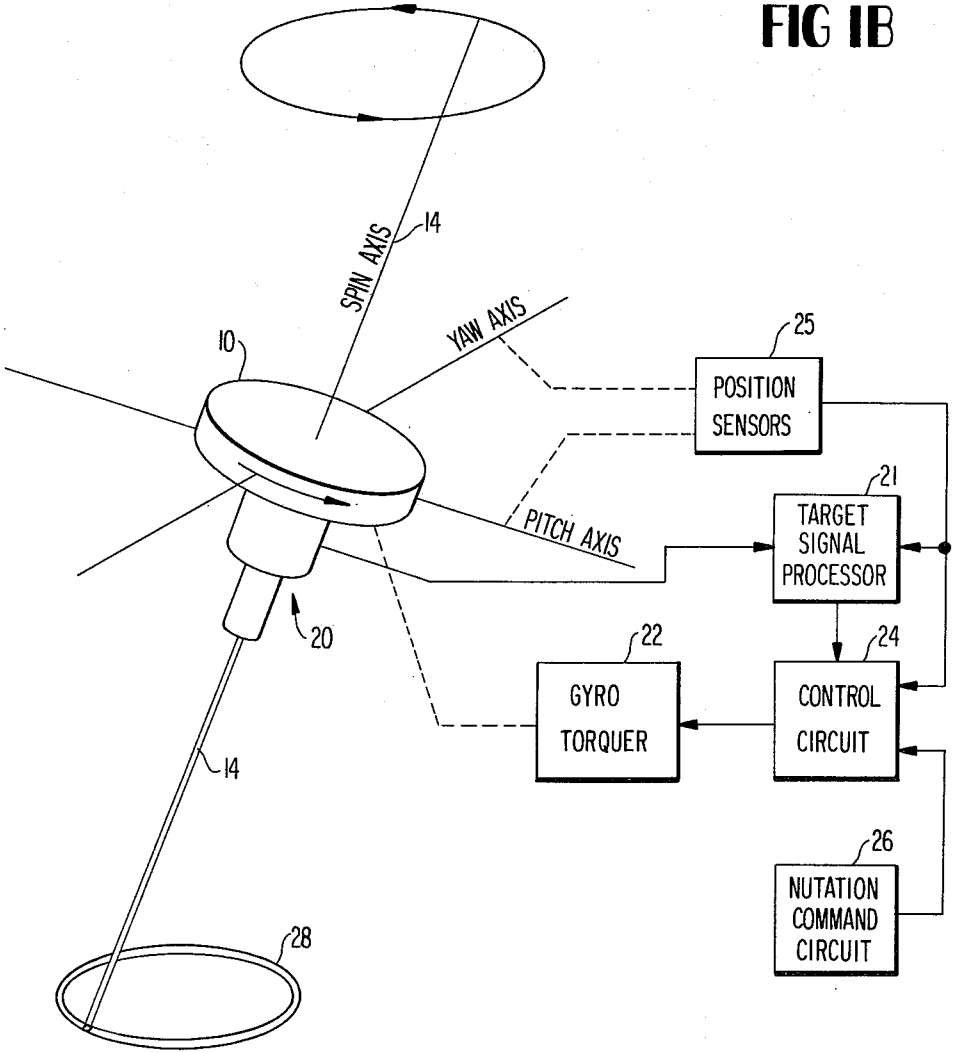
FIG. 1B is a schematic representation of a space stabilized scanning system broadly illustrating the principles of the present invention.
Figure 1A:
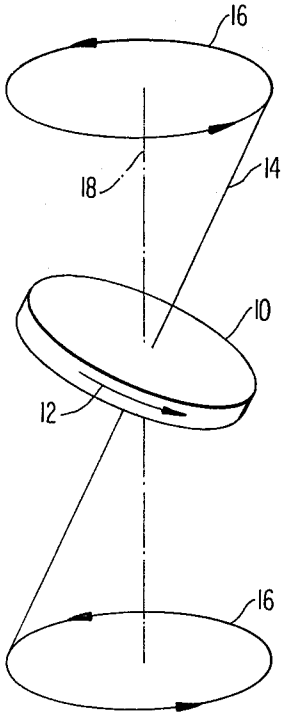
FIG. 1A is a schematic diagram illustrating nutation of a gyroscope momentum wheel.

The present invention may be more clearly understood through initial reference to FIGS. 1A and 1B wherein nutation of a spinning mass such as a gyroscope momentum wheel is illustrated.

FIG. 1A illustrated a spinning mass such as a gyroscope momentum wheel 10. The momentum wheel 10 is typically mounted on gimbals (such as those shown in FIG. 6) so as to permit the wheel to axially rotate in the direction indicated by the arrow 12, while permitting the wheel to move with the degrees of freedom required for the particular application, e.g. two degrees of freedom, pitch and yaw, in the application illustrated and described. The spinning momentum wheel 10 has a certain degree of stability in space while the gimbals will typically move with the supporting structure on which they are mounted as occurs when the entire gyroscope assembly is mounted in a missile. Despite the movement of the supporting structure for the gyroscope, the gyroscope momentum wheel will maintain its same reference orientation in space.

There is, however, an inherent instability of a spinning mass such as the wheel 10, and this instability causes a slight "wobbling" of the spinning mass about its spin axis 14. This "wobbling" is referred to as nutation, and the nutation occurs naturally at a frequency that varies with factors mentioned hereinafter. It can be seen from FIG. 1A that the natural nutation of the momentum member takes the form of a circular oscillation in inertial space, i.e. points along the spin axis 14 moves in circles 16 centered about an inertially stable axis 18 that would coincide with the gyroscope spin axis if there were no gyroscope nutation. The axis 18 is, in fact, the ideal or desired space stabilized reference.

It can be seen that natural gyroscope nutation is undesirable in any conventional space stabilized sensor positioning system since this natural gyroscope movement results in a perturbation of the sensor line-of-sight in addition to that caused by the sensor positions mechanism. According to the present invention, however, a controlled variable nutation of the gyroscope momentum wheel is induced to cause a controlled movement of the sensor line-of-sight as generally illustrated in FIG. 1B. The nutation induced and controlled in accordance with this invention thereby eliminates the need for any auxillary mechanism previously used for sensor scanning or the like. Despite this induced nutation of the gyroscope, a space stabilized reference is maintained as will be seen hereinafter.

One manner in which this induced, controlled nutation of a spinning mass may be employed to control the movement of a sensor is illustrated generally in FIG. 1B. Referring to FIG. 1B, a sensor 20, such as a light detector and its associated optics, is mounted so that the sensor line-of-sight has a known orientation relative to the spin axis 14. For example, the sensor 20 and/or its associated optics may be mounted on the spinning momentum wheel of the gyroscope or in any other suitable manner such that the sensor line-of-sight is coincident with the gyroscope spin axis as schematically illustrated in FIG. 1B. In such an arrangement, energy received along the gyroscope spin axis will be detected by the sensor.

The sensor 20 supplies signals to a target signal processor 21 where signals are developed during target acquisition and track in order to cause the sensor line-of-sight to be pointed in the desired direction. The signals may be developed by any suitable known technique (e.g. closed loop tracking using conventional null processing techniques) and the signals thus developed may be provided to a control circuit 24 which controls precession and nutation of the gyroscope momentum wheel as is described hereinafter in detail. Also, various signals may be provided to a nutation command circuit 26 to control the nutation patterns according to the mode of operation (e.g. search, track, etc.) as described hereinafter.

A gyroscope torquer 22 selectively torques the momentum wheel 10 in response to torque control signals from the control circuit 24. The control circuit 24 receives position feedback signals from position sensors 25 connected to the gyroscope momentum wheel 10, receives the previously described signal from the processor 21 and receives a nutation amplitude control signal from a nutation command circuit 26. The control circuit 24 uses these signals to generate torque control signals that cause the momentum wheel 10 both to nutate and move the sensor line-of-sight along a desired path or pattern 28 (e.g. for scanning a target area or the like) as well as precess to keep the center of the pattern on a desired point such as a target as will hereinafter be described in detail.

It will be appreciated that the sensor line-of-sight will be moved through a controlled pattern as a result of a controlled nutation of the gyroscope momentum wheel. As will be seen hereinafter, the nutation frequency is quite high relative to ordinary changes in the orientation of the gyroscope momentum wheel relative to the missile body or other support structure. Accordingly, low frequency, space stabilized reference data may be obtained by appropriate filtering that retains the low frequency components of the position feedback signals and rejects the high frequency (nutation) components. The low frequency component may thus be used for generation of tracking or other "low frequency" pointing error signals (e.g. in the processor 21).

It will thus be appreciated that the sensor line-of-sight may be moved in space (e.g. in a scanning pattern such as a rosette) by nutation of the space stabilized momentum wheel to which the sensor is referenced. Moreover, mechanical damping and separate optical/mechanical scanning mechanisms are not required.

Figure 2A:
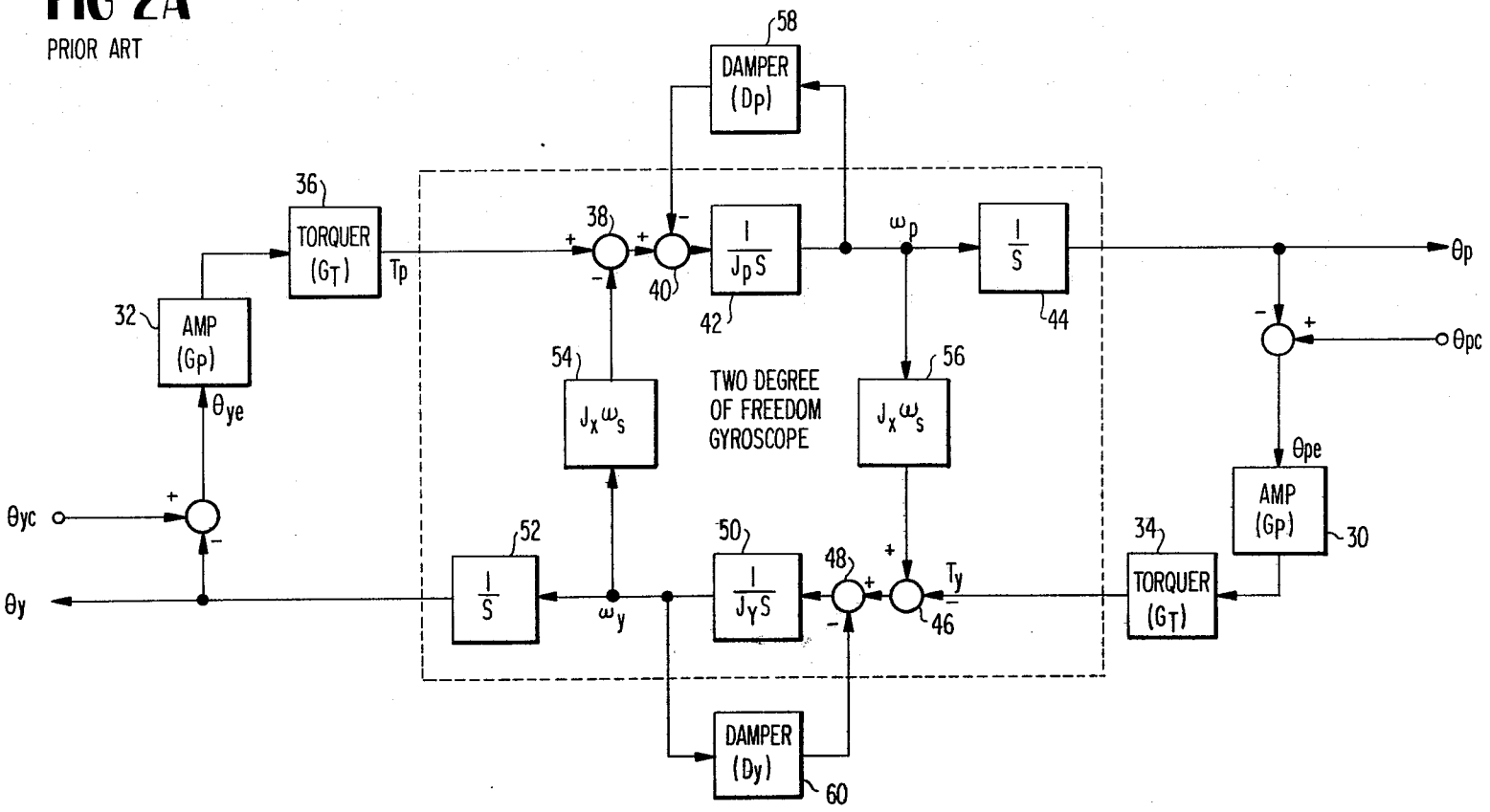
FIG 2A PRIOR ART
FIG. 2A is a block diagram functionally illustrating a prior art gyroscope system using mechanical nutation damping.

FIG. 2A is block diagram functionally illustrating a conventional system that uses a two-degree of freedom gyroscope in a conventional manner to control the line-of-sight of a sensor or other device. In the illustrated system, the line-of-sight is defined by the pitch and yaw output angles $\theta P$ and $\theta Y$. The system operates so as to cause the line-of-sight angles $\theta P$ and $\theta Y$ to track a commanded line-of-sight defined by the angles $\theta PC$ and $\theta YC$. Command line-of-sight signals may be provided in various conventional ways depending on whether the system is in search, acquisition or track mode. Error signals $\theta Pe$ and $\theta Ye$ are produced as a function of differences between the output angles $\theta P$ and $\theta Y$ and the commanded angles $\theta Pc$ and $\theta Yc$. Pick-offs on the gimbals may produce the error signals for pointing required during acquisition, or the error signals can be produced by a tracking sensor during the tracking phase.

The pitch and yaw error signals are amplified by respective amplifiers 30 and 32 and applied to torquers 34 and 36 to produce torques about the gimbal axes. The dynamics of the gyroscope are represented in La Place notation by the blocks 38, 40, 42, 44, 46, 48, 50 and 52. The angular momentum of the gyroscope wheel about the spin axis is represented by the blocks 54 and 56 while the blocks 58 and 60 represent the mechanical dampers presently used to reduce the effects of nutation.

With the arrangement of FIG. 2A it is impossible to use movement of the momentum wheel to accomplish large area scans with a narrow instantaneous field of view in a reasonable amount of time. The small maximum torques available from practical torquers limit the maximum angular rate of movement of the gyro that can be achieved.

Figure 2B:
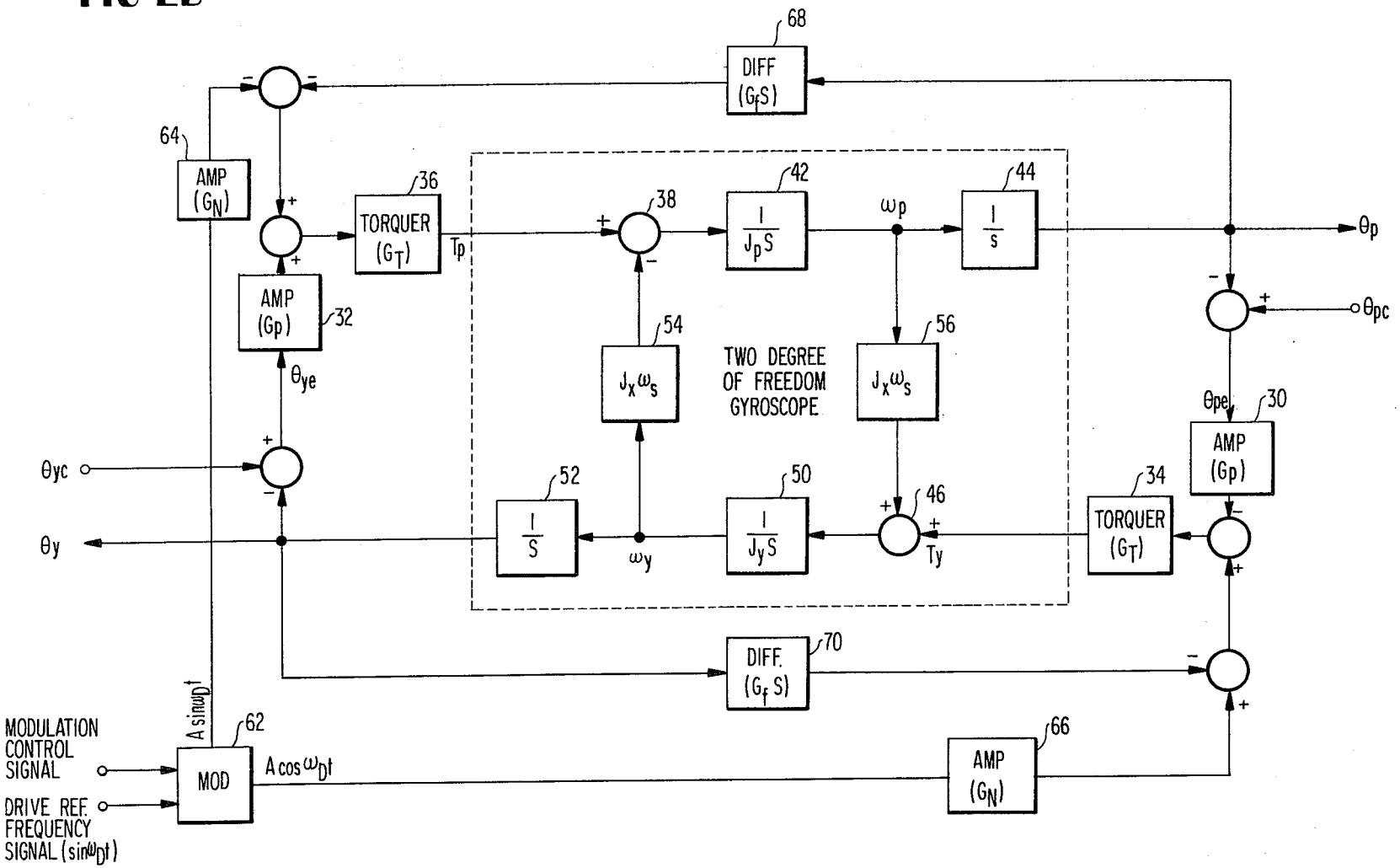
FIG. 2B is a block diagram functionally illustrating the principles of the present invention as applied to a system such as that of FIG. 2A.

In accordance with the present invention, the mechanical dampers 58 and 60 shown in FIG. 2A are eliminated and a control arrangement such as that illustrated in FIG. 2B is provided in order to induce a controlled nutation for search, acquisition, track or like functions. With the arrangement of FIG. 2B, the limit on the maximum movement rate is removed. In FIG. 2B, elements numbered 30–56 correspond to like numbered elements in FIG. 2A. Thus, the device illustrated in FIG. 2B preserves the ability to precess the gyroscope at the low angular rate required for pointing and tracking tasks.

Referring to FIG. 2B, the extremely high angular movement rate required for scanning is obtained by exciting the two torquers 34 and 36 with a signal which is at the natural gyroscope nutation frequency and is in quadrature time phase at the torquers. With this type of torquer excitation, the mechanical impedance presented by the gyroscope to the torquers is minimal. FIG. 3 is a plot of the mechanical impedance as a function of the ratio of drive or excitation frequency to natural nutation frequency. FIG. 3 shows that for a drive frequency close to the natural nutation frequency (e.g. within about 0.5%), the impedance is characterized by a deep notch.

Returning to FIG. 2B a modulator 62 provides quadrature phase output signals for which the frequency is determined by a drive reference frequency input signal and the amplitude is controlled by a modulation control signal. The sine and cosine output signals from the modulator 62 are amplified by conventional amplifying circuits 64 and 66, respectively, and are summed with gyroscope rate signals produced by differentiating circuits 68 and 70, respectively. The sum signals are then summed with the signals from amplifiers 32 and 30, respectively, and are applied to the respective torquers 36 and 34.

It can be seen that the differentiators 68 and 70 form closed feedback loops in which gimbal angle rates are fed back to the gimbal torquers. These feedback loops are commanded by the output signals of the amplifiers 64 and 66. Thus, by changing the amplitudes of the sine and cosine drive signals (e.g. by varying the magnitude of modulation control signal), the angular rates of the gimbals can be changed. If the sine and cosine drive signals are reduced to zero amplitude, the rate feedback of the loops acts to provide damping as with the mechanical damper of the conventional gyroscope system of FIG. 2A.

Since operation of the loops is at a unique, nearly constant frequency (the gyroscopic nutation frequency), commanding angular rate is equivalent to commanding the angular displacement of the gimbal. To avoid disturbing the response of the conventional tracking loops which utilize only low frequency signals, the differentiators 68 and 70 can be built with a narrow bandpass characteristic centered about the higher nutation frequency. This prevents a low frequency tracking component of gimbal movement from being fed back to the torquers.

Figure 4:
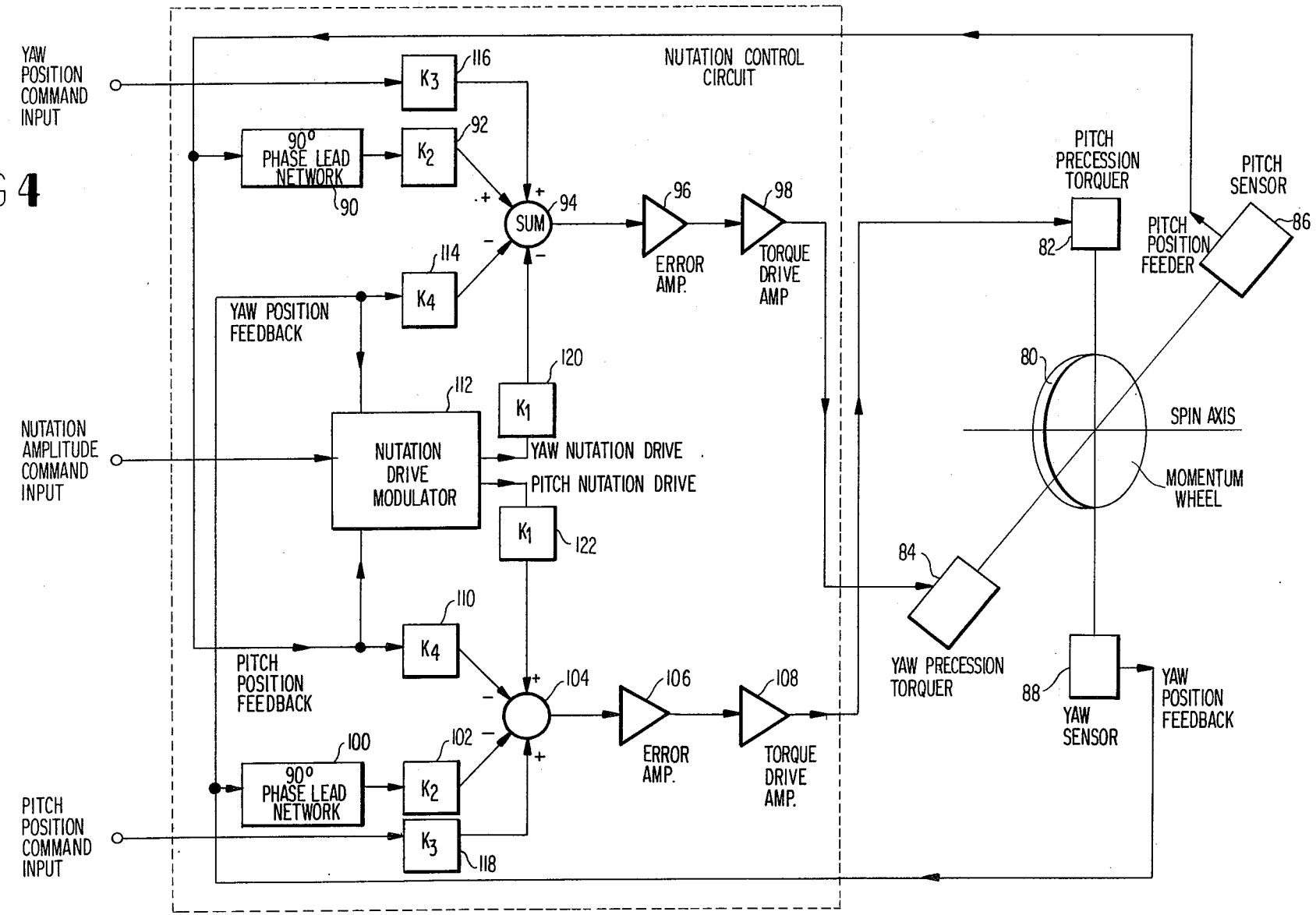
FIG. 4 is a detailed functional block diagram of one embodiment of a control circuit for selectively inducing and controlling nutation of a gyroscope assembly in accordance with the present invention.

One embodiment of a circuit for inducing and controlling nutation in accordance with the present invention is illustrated in detail in the block diagram of FIG. 4. Referring now to FIG. 4, the momentum wheel 80 of the gyroscope rotates about the spin axis and is precessed about the pitch and yaw axes by a pitch precession torquer 82 and a yaw precession torquer 84, respectively.

A pitch sensor 86 senses the pitch position of the momentum wheel 80 and provides a pitch position feedback signal to the nutation control circuit. Similarly, a yaw position sensor 88 senses the yaw position of the momentum wheel 80 and provides a yaw position feedback signal to the nutation control circuits.

The pitch position feedback signal is supplied through a suitable conventional 90° phase lead network 90 and a gain or amplitude scaler 92 as a positive input signal to a suitable conventional signal summer 94. The output signal from the summer 94 is supplied through an error amplifier 96 and a torquer drive amplifier 98 to the yaw precession torquer 84.

The yaw position feedback signal is supplied through a 90° phase lead network 100 and through a scaler 102 as a negative input signal to a conventional signal summer 104. The output signal from the summer 104 is supplied through an error amplifier 106 and a torque drive amplifier 108 to the pitch precession torquer 82.

The pitch position feedback signal is also supplied through a conventional scaler 110 as a negative input to the summer 104 as well as to a nutation drive modulator 112. Similarly, the yaw position feedback signal is supplied to the nutation drive modulator 112 and through a suitable scaler 114 as a negative input to the summer 94.

A yaw position command input signal is supplied through a convention scaler 116 as a positive input to the summer 94. A pitch position command input signal is supplied through a scaler 118 as positive input to the summer 104. A nutation amplitude command input signal is supplied to the nutation drive modulator 112 and the respective yaw and pitch nutation drive signals from the nutation drive modulator 112 are supplied through respective scalers 120 and 122 as respective negative and positive inputs to the summers 94 and 104.

In operation, the yaw and pitch position command input signals are supplied in a suitable conventional manner in order to precess the gyroscope momentum wheel 80 at the low angular rates required for pointing and tracking tasks as was previously mentioned. The pitch and yaw position feedback signals are supplied to the summers 104 and 94 as negative feedback signals. Yaw axis damping is obtained by phase-lead processing the pitch position feedback signal and summing this signal with the pitch position command input signal and with the pitch nutation drive signal at the summer 104. Similarly, pitch axis damping is obtained by phase-lead processing the yaw position feedback signal and smming the out of phase version (negative) thereof with the pitch position command input signal and with the pitch nutation drive signal.

The damping signals are summed out of phase with their respective yaw and pitch nutation drive signals from the nutation drive modulator 112. The resulting error signals are amplified by their respective error and torque drive amplifiers and applied to the precession torquers.

The pitch precession torquer 82 exerts a torque about the yaw axis and the yaw precession torquer 84 exerts a torque about the pitch axis as illustrated. The torque of the pitch precession torquer results in precession about the pitch axis because of the cross-product relationship created by the momentum wheel 80. Similarly, the torque applied by the yaw precession torquer 84 results in a precession about the yaw axis despite the fact that this torquer acts along the pitch axis.

With the foregoing arrangement, the error signals produced by the summers 94 and 104 tend to maintain a constant nutation amplitude for a constant nutation command input signal to the nutation drive modulator 112. The nutation amplitude may be varied continuously (e.g. in a spiral scan) or otherwise as desired by varying the amplitude of the nutation command input signal as will be more fully appreciated hereinafter.

For example, when looking for a target, it may be desirable to rapidly scan the sensor line-of-sight by moving the gyroscope momentum wheel through a predetermined pattern centered about a fixed point in space or centered about a point in space that is slowly moved. According to the embodiment of the invention shown in FIG. 4, this type of scanning can be accomplished by controlling the nutation amplitude command input to control the rapid movement (nutation) of the gyroscope momentum wheel in a desired manner and by simultaneously controlling the yaw and pitch position command signals to produce the desired positioning of the center of the scan pattern (i.e. the desired slow or low frequency procession components of the momentum member).

When the target is actually located in response to appropriate information from the sensor 20 (see FIG. 1B), the processor 21 can indicate to the nutation command circuit 26 that a different high frequency nutation pattern is desired and can additionally precess the gyroscope with the yaw and pitch position command signals to center the newly commanded pattern on the target. It will be appreciated that target tracking can also proceed as set forth above, with controlled precession of the gyroscope momentum wheel 80 to keep the target in the center of a desired nutation pattern (e.g. a circle). With such an arrangement it will be clearly seen that the system can be made to track an area target and the circular or other nutation pattern can be controlled to increase in size during range closure.

As was previously mentioned, one important aspect of the present invention involves controlling the frequency of nutation excitation to maintain correspondence with the natural resonant nutation frequency of the momentum wheel 80. The excitation frequency must be maintained very close to the nutation frequency (within about 0.5%) to minimize torque excitation requirements and corresponding power input requirements. One difficulty encountered in maintaining this desired one-to-one frequency relationship between excitation and natural resonance results from the fact that the natural resonant frequency is directly proportional to the momentum wheel spin axis frequency. The natural frequency, therefore, varies with changes in spin axis frequency.

In accordance with the present invention, the nutation drive modulator 112 maintains a one-to-one frequency relationship between the excitation frequency of the momentum wheel torquers and the natural resonant frequency of the momentum wheel. The nutation drive modulator 112 accomplishes this by maintaining a fixed phase relationship between each gimbal axis nutation component and the torquer excitation signal for that gimbal axis. The gimbal axis nutation component is obtained as the output signal of one or both of the pitch or yaw position sensors as illustrated in FIG. 4. A zero or very small phase angle between the position sensor output signal and the excitation torque signal is maintained by changing the torque excitation frequency as commanded by the closed loop feedback system to minimize the relative phase difference between the two signals.

One embodiment of the nutation drive modulator 112 of FIG. 4 is illustrated in greater detail in FIG. 5 to facilitate an understanding of the operation of the invention.

Referring now to FIG. 5, the pitch position feedback signal is applied to a suitable, conventional bandpass filter 130, and the output signal from the bandpass filter 130 is amplified by a conventional zero voltage reference comparator 132 and supplied to a conventional phase-locked loop 134. The output signal from the phase-locked loop 134 controls the switching of a conventional analog switch as illustrated schematically at 136.

The yaw position feedback signal is applied to a conventional phase demodulator 138 and the output signal from the demodulator 138 is applied to a conventional summing circuit 140. A nutation amplitude control signal is applied to the second input terminal of the summing circuit 140 and the output signal from the summing circuit 140 is applied through an error amplifier 142 to one input contact of the analog switch 136. The signal from the error amplifier 142 is also inverted by an inverter 144 and supplied to a second input terminal of the analog switch 136.

The output signal from the analog switch 136 is applied through a bandpass filter 146 to an input terminal of the phase demodulator 138, to an input terminal of an inverter 148, and to an output terminal 150 as the yaw nutation drive signal. The output signal from the inverter 148 is applied to a conventional 90° lag network 152 and the signal from the lag network 152 is supplied to an output terminal 154 as the pitch nutation drive signal.

In operation, the nutation drive modulator 112 maintains the nutation excitation frequency (i.e. the frequency of the nutation drive signals) as close as possible to the natural nutation frequency of the momentum wheel to minimize the torque level required to achieve the desired scanning angles. This is important because the gyroscope has a high Q mechanical resonance associated therewith.

In this connection, the bandpass filter 130 filters out (e.g. substantially attenuates) any frequency components of the pitch position feedback signal above and below predetermined upper and lower frequencies. Accordingly, the bandpass filter output signal represents nutation of the gyroscope momentum wheel about the pitch gimbal axis with components representing low and high frequency movement such as guidance commands and vibration removed. For example, the natural nutation frequency of the gyroscope may be some high value and the bandpass filter may be centered at this value.

The amplifier 132 ensures that the signals supplied to the phase-locked loop 134 is a square wave rather than a sinusoidal signal. The phase-locked loop includes an oscillator and the oscillator frequency is maintained at a 90° phase lead relative to the gyroscope pitch nutation position signal developed by the position feedback sensor. The phase-locked loop, in essence, tracks changes in the gyroscope spin speed and the like. The excitation frequency ($\mu_d$) produced by the phase-locked loop is maintained very close to the natural nutation frequency ($\mu_n$) by driving the phase-locked loop oscillator to a frequency that produces zero phase shift between the yaw nutation position and the yaw nutation drive or excitation signal. Since the phase-locked loop includes a phase detector that maintains a 90° phase shift between the input and output signals, the pitch position feedback signal is used to drive the phase-locked loop in the illustrated embodiment.

The amplitude of gyroscope nutation is controlled at any instant by the nutation amplitude command signal. The average rectified amplitude of the yaw position feedback signal is sensed by the phase demodulator 138 and is summed algebraically with the nutation amplitude command signal. The sum voltage is amplified by the error amplifier 142 and chopped by the analog switch 136 to produce a square wave having a frequency $F_d$, peak amplitude equal to an error voltage E (related to the nutation amplitude command), and a zero d.c. component.

Figure 6A:
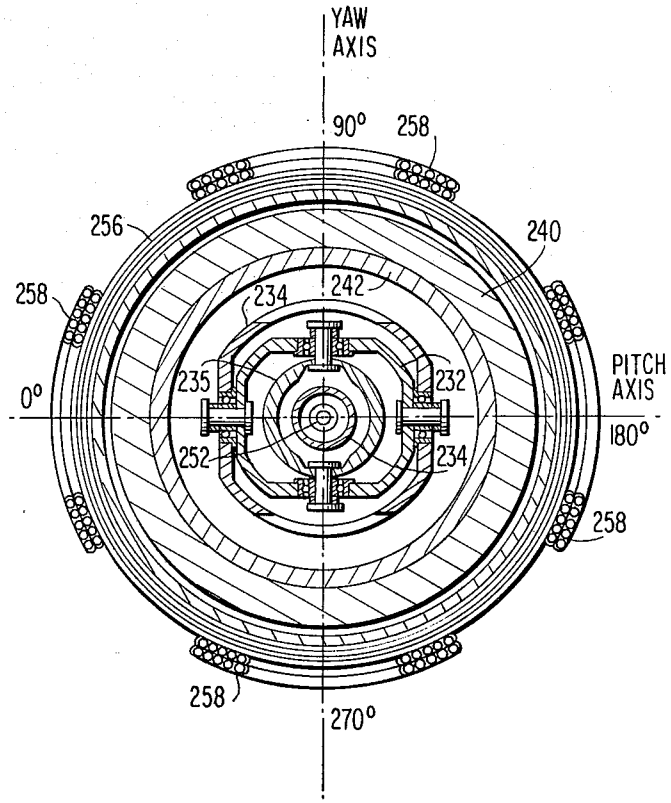
FIG. 6A is a view in cross section of the gyroscope assembly of FIG. 2 taken along the line A—A; and, FIG. 7 is a modified form of the system of FIG. 4.

The square wave is filtered by the filter 146 to produce a cosine wave that is referenced to a coordinate system in which the pitch axis corresponds to 0° as shown in FIG. 6A. This produces the yaw nutation drive signal and, through inversion and a 90° lag applied to the yaw nutation drive signal, the pitch nutation drive signal is produced. As a result, the signal $-E \sin \mu_d t$ is produced for a pitch axis drive and the signal $E \cos \mu_d t$, which lags the pitch nutation drive signal by 90°, is produced for the yaw axis drive.

It can thus be seen that the nutation movement induced in accordance with the system of FIGS. 4 and 5 can be varied as a function as the nutation amplitude command signal. For example, a substantially circular scan may be obtained with a d.c. nutation amplitude command voltage that remains substantially constant. A spiral scanning pattern results from the application of a ramp nutation command signal. Other scanning patterns may be produced by varying the nutation amplitude command voltage.

Figure 6:
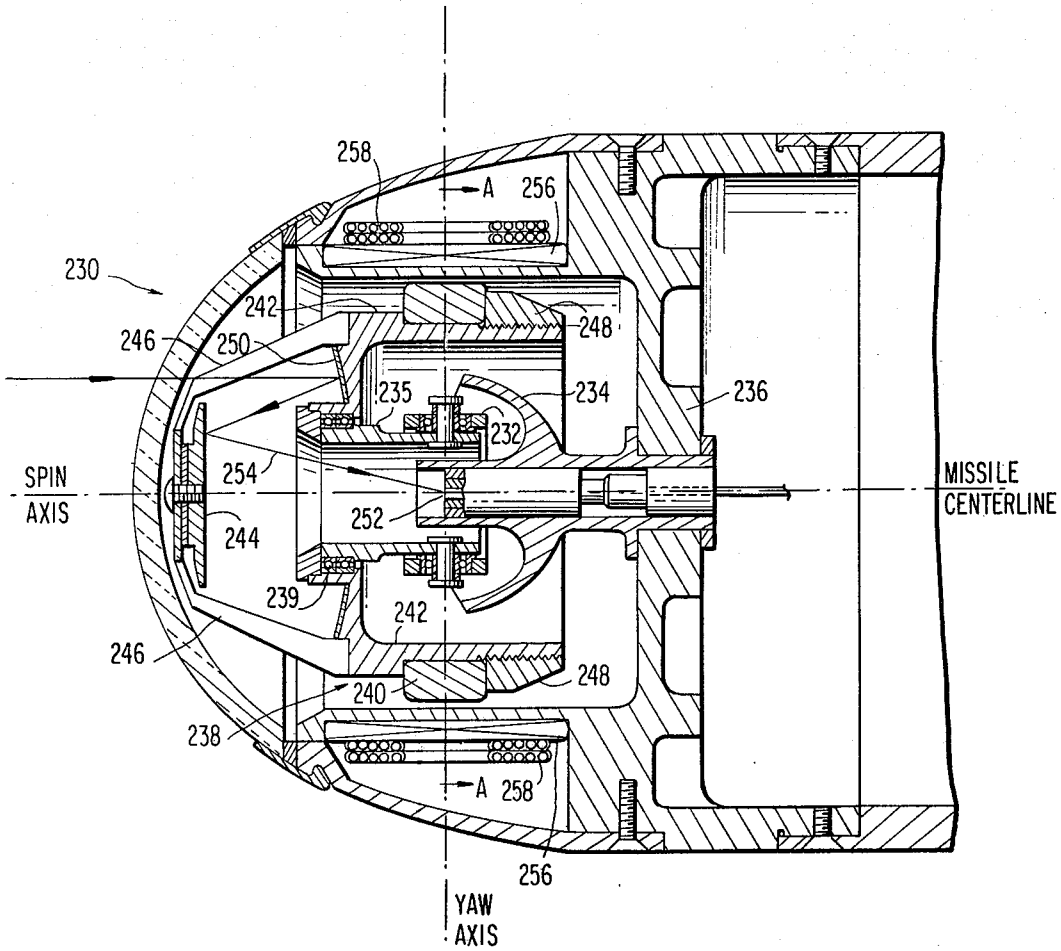
FIG. 6 is a view in cross section of one embodiment of a gyroscope assembly with which the present invention may be used.

A gyroscope assembly particularly useful in conjunctions with the present invention is illustrated in FIGS. 6 and 6A to facilitate an understanding of the operation of the present invention. The gyroscope assembly is shown mounted in the nose 230 of a missile as in the case where it is used as a radiant energy seeker for missile guidance.

Referring to FIGS. 6 and 6A, the gyroscope assembly is mounted in a conventional manner on gimbals 232 and 234 connecting a rotor axle 235 to a fixed gyroscope base 236. The axle 235 is hollow and extends along the spin axis of the gyroscope toward the nose of the missile. A momentum wheel 238 is journaled for rotation on the rotor axle 235 through the provision of suitable bearings 239.

The momentum wheel 238 of the gyroscope assembly includes a ring-shaped magnet 240 mounted on a frame 242 that is journaled on the bearings 239. A reflector assembly including a first reflector 244 such as a metallic mirror is connected to the frame 242 by connecting arms 246 and rotates therewith. A balance weight 248 is mounted on the frame to balance the mirror assembly when the momentum member 238 spins. The balance weight 248 may also hold the magnet 240 in place on the frame 242 through the illustrated threaded connection.

An annular reflector 250 such as a metallic mirror is provided on an outer surface of the support 242 and rotates with the support. The reflector 250 has a concave spherical surface such that rays parallel to the gyro axis which are intersected at the surface of the reflector 250 will be focused on the spin axis. The focus point will depend on the spacing between the reflectors, 244 and 250, the curvature of the mirror and other such factors as will be seen hereinafter.

A detector or sensor 252 is mounted on the support 236 that is fixed relatively to the missile body. The sensor 252 is positioned at the intersection of the spin, pitch and yaw axes. It can thus be seen that energy such as light striking the surface of the reflector 250 from within a desired angular field-of-view is reflected from the reflector 250 to the surface of the reflector 244 and to the surface of the sensor 252 as is indicated by the line 254. Energy received within the sensor field-of-view is reflected to the surface of the detector 252 at all the various possible positions of the momentum member relative to the fixed support 236 within the forward looking limits of the momentum member (e.g. ±25 degrees from missile centerline).

A torquer coil 256 concentric with the momentum member is mounted on the fixed support 236 and surrounds the momentum wheel in the vicinity of the magnet 240. In addition, a plurality of spin coils 258 are spaced around the periphery of the momentum member in the vicinity of the magnet 240 as illustrated. The torquer coil 256 comprises a plurality of turns of wire that completely encircle the momentum wheel. The spin coils 258 comprise toroidal coils spaced 90° apart. These coils 258 act as stator coils of a motor to cause the momentum wheel to spin at a desired speed as will hereinafter described in greater detail.

In operation, the spin coils 258 are energized at a predetermined frequency so as to cause the momentum wheel to rotate at a predetermined angular velocity about the spin axis on the bearings 230. For example, the four spin coils shown in the illustrated embodiment may be synchronously energized by a phase locked, crystal controlled oscillator signal having a radian frequency of 440 radians per second. This produces a spin velocity of about 70.1 HERTZ.

The gyroscope momentum wheel, when caged, rotates about the missile center line as illustrated in FIG. 6. Caging to hold the momentum wheel in this position may be accomplished in any suitable conventional manner either electrically or mechanically or through some combination thereof.

As is illustrated by the line 254, energy striking the mirror 250 is reflected to the mirror 244 and to the detector 252 if such energy is within the predetermined sensor field-of-view. When tracking a target, target tracking errors are developed and the sensor line-of-sight may be moved to follow the target by applying appropriate torquer signals to the torque coil 256 and thereby causing precession by the gyroscope momentum wheel. Missile guidance signals may be generated in response to the target tracking errors or the torquer signals to align the missile centerline with the spin axis, i.e. to cause the sensor line-of-sight, the the target line-of-sight and the missile centerline to coincide.

For example, if the target is above the spin axis, an appropriate signal is applied to the torquer 256 to cause the gyroscope momentum wheel to precess about the pitch axis in an up direction until the sensor line-of-sight and the target line-of-sight coincide. Similarly, if the target is to the left or right of the missile centerline as illustrated in FIG. 6, torquer signals are applied to the torquer coil 256 to cause the gyroscope momentum wheel to precess about the yaw axis. From these torquer signals, or from the tracking error signals that develope the torquer signals, missile guidance signals are developed in any suitable convention manner in order to steer the missile so that the missile centerline and the spin axis stay coincident or or in some other predetermined relationship that will accurately guide the missile to the target.

For example, yaw precession results in the illustrated embodiment when a sine function current I sin $\mu_s t$ is applied to the torquer coil. Pitch precession results from the application of a cosine function current I cos $\mu_s t$ to the torquer coil. It should be noted that the zero reference angle for these sine and cosine functions is the condition in which the north magnetic pole of the magnetic rotor 256 lies along the pitch axis to the left as shown in FIG. 6A. Precession may thus be selected in one or the other direction along the yaw axis by exciting the torquer coil with either the I sin $\mu_s t$ or $-$I sin $\mu_s t$ signals.

While torquer signals have heretofore been utilized as described above to cause a slow precession of the gyroscope momentum wheel for tracking purposes, the present invention additionally utilizes appropriate torquer signals applied to the torquer coil 256 to cause a controlled, rapid variation of the momentum wheel axis. This rapid, controlled nutation causes the sensor line-of-sight to move in a continuously variable scanning pattern for target search, acquisition or tracking purposes without loss of the space stabilized reference provided by the momentum wheel.

Figure 7:
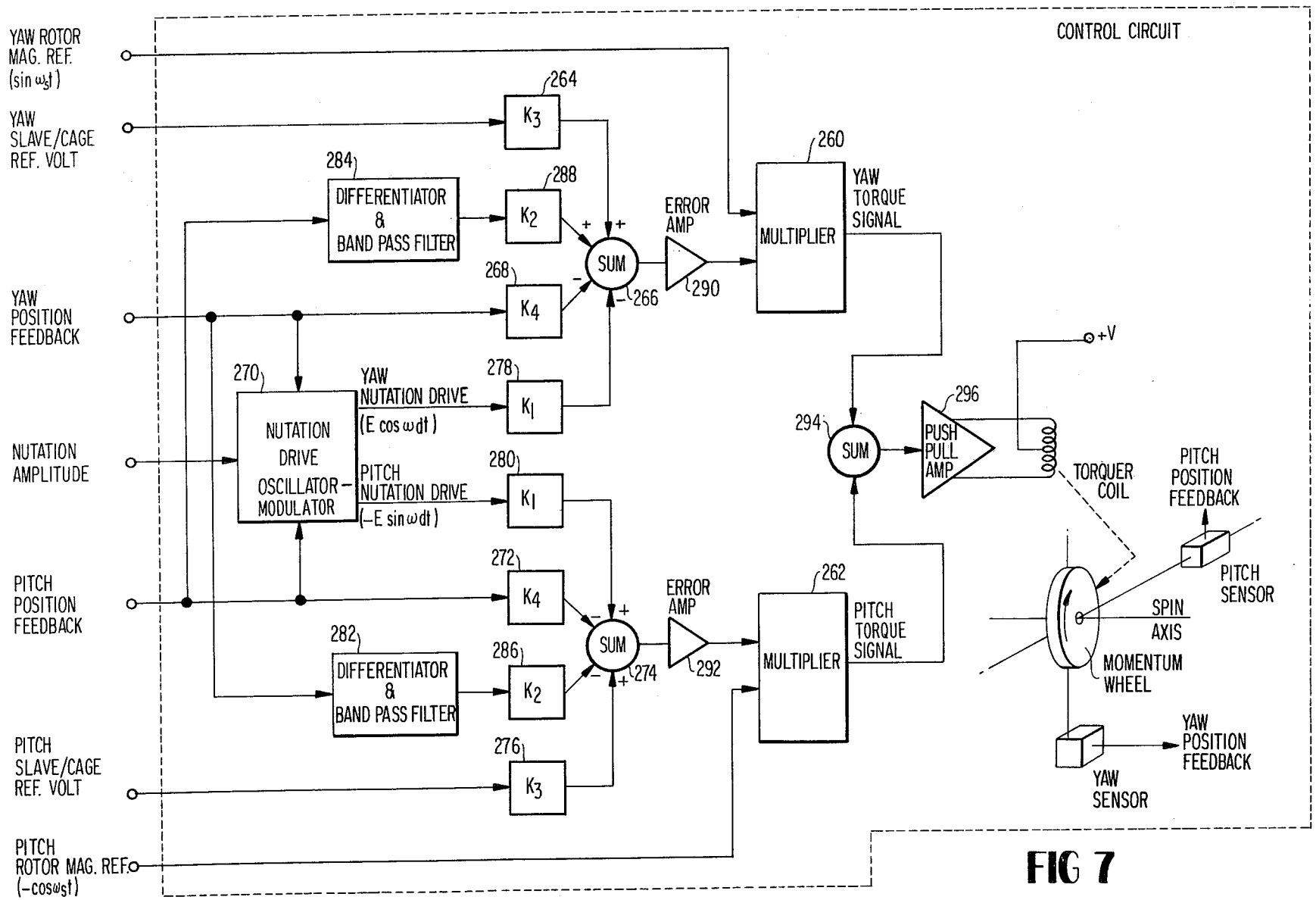

Another embodiment of the present invention useful for inducing and controlling nutation of a gyroscope momentum wheel such as that illustrated in FIG. 6 is shown in the block diagram of FIG. 7. Referring now to FIG. 7, a yaw rotor magnetic reference signal is supplied to a suitable conventional signal multiplier 260 and a pitch rotor magnetic reference signal is supplied to a similar multiplier 262. A yaw slave/cage reference voltage is gain scaled by a suitable convention gain or amplitude scaler 264 and supplied to a suitable convention summing circuit 266.

The yaw position feedback signal from the yaw position sensor previously mentioned is applied through a suitable gain or amplitude scaler 268 to the summing circuit 266 and to a nutation drive modulator 270 preferably of the type previously described in connection with FIG. 5. The pitch position feedback signal from the pitch position sensor previously mentioned is applied through a conventional gain or amplitude scaler 272 to a conventional summing circuit 274 and to the nutation drive modulator 270. A pitch slave/cage reference voltage is applied through a suitable gain or amplitude scaler 276 to the summing circuit 274. to the nutation drive modulator 270. The nutation drive modulator supplies a yaw nutation drive signal in the form of a signal E cos $\mu_d t$ through a suitable gain or amplitude scaler 278 to the summing circuit 266. In addition, the nutation drive modulator 270 supples a pitch nutation drive signal in the form of a signal $-E \sin \mu_d t$ through a suitable gain or amplitude scaler 280 to the summing circuit 274.

The yaw and pitch position feedback signals are also applied to respective conventional differentiator and bandpass filter circuits 282 and 284. The signal from the differentiator and bandpass filter 282 is supplied through a suitable gain or amplitude scaler 286 to the summing circuit 274 and the output signal from the differentiator and bandpass filter 284 is supplied through a suitable gain or amplitude scaler 288 to the summing circuit 266. The combined output signal from the summing circuit 266 is supplied through a suitable conventional amplifier 290 to a second input terminal of the multiplier 260. The output signal from the summing circuit 274 is supplied through a suitable conventional amplifier 292 to the second input terminal of the multiplier 262.

The multiplier 260 combines its two input signals and produces a yaw precession signal. Similarly, the multiplier 62 combines its two input signals and produces a pitch precession signal. The yaw and pitch precession signals are summed by a conventional summing circuit 294 and supplied to a conventional push-pull amplifier 296. The push-pull amplifier 296 supplies the torquer control signal that is applied to the precession torquer coil (e.g, the coil 256 of FIG. 6) in order to cause precession of the momentum wheel of the gyroscope in a desired manner.

In operation, the various input signals for each precession direction are supplied to the control circuit for processing to produce the precession control signals. For example, the yaw procession signal is a product of the yaw rotor magnetic reference signal times the algebraic sum of: the yaw slave/cage reference voltage, the yaw position feedback signal, the differentiated and filtered pitch position feedback signal, and the yaw nutation drive signal.

The yaw and pitch rotor magnetic reference signals are rotor spin rotational steering signals produced by a spin position angle sensor and used to generate required pitch and yaw precession torque signals. The yaw and pitch slave/cage reference voltages are produced by remote potentiometer controls and used to position the nutation axis to any particular point within the pitch and yaw gimbal units.

The yaw and pitch nutation amplitude signals are produced by a suitable signal generator that supplies a signal appropriate to the type of scanning desired. As was previously mentioned, for example, a circular scan of a desired angular coverage may be produced using a nutation amplitude signal that is merely a fixed d.c. signal of some predetermined magnitude. To change the angular coverage the magnitude of this d.c. signal can be varied. Thus, for a spiral scan or other such scan pattern which varies about some central axis, the nutation amplitude signal can be made to continuously vary in an appropriate manner, e.g. a saw-tooth wave. In a system in which various scanning patterns may be used for different purposes such as acquisition and tracking, the signal generator supplying the nutation amplitude signal may be conventionally controlled to selectively produce the signal desired at a particular time.

The yaw and pitch position feedback signals represent the position of the momentum member in the yaw and pitch directions relative to some reference positions. These feedback signals may be produced in any suitable conventional manner such as with an optical pickoff, an encoded disk or the like.

With continued reference to FIG. 7, the pitch and yaw position feedback signals are appropriately gain scaled by the respective gain scalers 272 and 268 in the respective pitch and yaw precession signal channels. The position feedback signals are also differentiated and filtered to produce rate feedback signals. The filtering limits the noise bandwidth and attenuates low frequency rate signals caused by vibration or other such movement that manifests itself as low frequency changes in the position feedback signals. In this regard, a conventional 100 HZ bandpass filter (e.g. a three pole Butterworth filter) may be utilized in the missile system described herein.

The various input signals to the summers 266 and 274 are all appropriately gain scaled and applied to the summers with the illustrated polarities to produce a nutation error signal for each precession direction. The nutation error signals for a particular precession directions are amplified by the error amplifiers 290, 292 and are multiplied each by its associated rotor magnetic reference signal (e.g. the yaw nutation error signal is multiplied by the yaw rotor magnetic reference signal). Thus, the multipliers 260 and 262 produce a precession command signal for each precession direction or gimbal axis.

The precession signals are composed of the torque or nutation error signal multiplied by the spin rotational steering or magnetic reference signal for each gimbal axis (e.g. the yaw nutation error signal times the yaw rotor magnetic reference signal for the yaw gimbal axis). Since, in the illustrated embodiment, there is a single torquer coil, the yaw and pitch precession signals are combined by the summing circuit 294 to produce a composite precession signal that contains combined pitch and yaw axis precession command information. This composite signal, applied to the push-pull amplifier, develops torque coil current magnitude and polarity that results in a precession of the momentum wheel related to the composite signal.

The presently disclosed embodiment is to be considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A system for scanning an area of interest in relation to a space stabilized reference axis comprising:

a momentum member rotatably mounted on a support so as to rotate about a spin axis and establish a space stabilized reference;

a sensor having a line-of-sight and being mounted with the line-of-sight in known relation to the space stabilized reference;

electrical signal responsive means cooperating with the momentum member for selectively applying torque to the member; and means for selectively generating a torquer control signal and applying said control signal to said signal responsive means, said control signal having characteristics causing a controlled nutation of the momentum member such that the spin axis and the sensor line-of-sight move through a desired scan pattern centered about the space stabilized reference.

2. The system of claim 1 wherein said electrical signal responsive means comprises a torquer coil surrounding the momentum member in spaced relation thereto.

3. The system of claim 1 wherein said torquer control signal generating means includes:

means for generating a position signal representing the position of the momentum member relative to the support;

means responsive to the position signal for generating a sinusoidal nutation command signal having a frequency essentially equal to a natural nutation frequency of the momentum member; and means for selectively controlling the amplitude of the nutation command signal.

4. The system of claim 3 wherein said amplitude controlling means comprises a signal generator for selectively producing a signal that repetitively varies in amplitude between a minimum value and a maximum value over a predetermined time period.

5. The system of claim 3 wherein said amplitude controlling means comprises means for generating a reference voltage having a constant level of selectable value.

6. The system of claim 1 wherein the momentum member is mounted for precession in two orthogonal directions relative to the support and wherein said signal responsive torque applying means applies torque in either of said two directions as a function of the phase of the applied torquer control signals, the torquer control signal generating means comprising means for generating position signals representing the position of the momentum member relative to the support in each of the two orthogonal directions, and means for generating a two phase torquer control signal in response to said position signals.

7. Apparatus for controlling the line-of-sight of a space stabilized system comprising:

a gyroscope having a momentum member and being connected to control the position of the line-of-sight of the space stabilized system;

torquer means for selectively applying torque to the momentum member to cause nutational movement of the momentum member and precessional movement of the gyroscope and thus movement of the line-of-sight; and circuit means connected to the torquer means for generating a torquer command signal and applying the torquer command signal to the torquer means, the torquer command signal including a slowly varying precession command signal component and an essentially sinuosidal nutation command signal component having a frequency very high in comparison with the precession command signal component, the nutation command signal component being controlled in frequency in relation to the natural nutation frequency of the momentum member so that torque applied to the momentum member has the proper time and spatial phasing to maintain controlled nutation and the precession command component has the characteristics to produce the desired precession rate and direction of the gyroscope.

8. The apparatus of claim 7 wherein the space stabilized system is a missile guidance system including a sensor of electromagnetic radiation, the line-of-sight of the system being coincident with the line-of-sight of the sensor.

9. The apparatus of claim 7 wherein the circuit means includes means for selectively controlling the amplitude of the nutation command signal to thereby selectively control the amplitude of nutation of the momentum member whereby various nutation patterns can be produced.

10. The apparatus of claim 8 wherein the circuit means includes means for selectively controlling the amplitude of the nutation command signal to thereby selectively control the amplitude of nutation of the momentum member and produce a desired scanning pattern of the line-of-sight of the sensor.

11. In a missile guidance system including a gyroscope having a momentum member rotatably mounted in the nose of the missile to establish a space stabilized reference, the momentum member having a spin axis and being mounted for movement relative to the missile about a pitch axis and a yaw axis, and a sensor having a line-of-sight and being mounted with the line-of-sight in known relation to the spin axis of the momentum member, a scanning system comprising:

means for producing a position signal representing the position of the momentum member relative to a reference on the missile;

means responsive to said position signal for exciting nutation of the momentum member in phase with the natural nutation of the momentum member; and means for filtering said position signal to extract a frequency component of said position signal below a predetermined frequency and representing changes in the position of said member exclusive of the nutation produced by said exciting means, said extracted frequency component thereby being related to the position of the reference on the missile relative to the established space stabilized reference.

12. A system for inducing and controlling nutation of a momentum member of a gyroscope comprising:

means for generating a nutation command signal having a frequency integrally related to the natural nutation frequency of the gyroscope momentum member;

means responsive to the nutation command signal for inducing movement of the momentum member at the frequency of the nutation command signal; and, means for selectively controlling the amplitude of the nutation command signal to control the amplitude of the induced movement.

13. The system of claim 12 wherein the nutation command signal generating means includes:

means for generating a position signal representing the instantaneous position of the momentum member relative to a fixed reference position; and means for controlling the frequency of the nutation command signal in response to the generated position signal.

14. The system of claim 13 wherein the controlling means comprises an oscillator generating the nutation command signal and controlling in frequency in response to the position signal.

15. The system of claim 12 wherein said amplitude controlling means comprises a signal generator for selectively producing a signal that repetitively varies in amplitude between a minimum value and a maximum value over a predetermined time period.

16. The system of claim 12 wherein said amplitude controlling means comprises means for generating a reference voltage having a selectable level.

17. A method for inducing and controlling nutation of a momentum member of a gyroscope comprising the steps of:

generating a sinusoidal electrical nutation command signal integrally related in frequency to a natural nutation frequency of the momentum member;

inducing movement of the momentum member at the natural nutation frequency in response to the nutation command signal; and selectively controlling the amplitude of the nutation command signal to control the amplitude of the induced movement.

18. The method of claim 17 wherein the amplitude of the nutation command signal is controlled by selectively producing a signal that repetitively varies in amplitude between a minimum value and a maximum value over a predetermined time period, and modulating the nutation command signal in response to the selectively produced signal.

19. The method of claim 17 wherein the amplitude of the nutation command signal is controlled by generating a reference voltage having a selectable level, and modulating the nutation command signal with the reference voltage.

20. The method of claim 17 wherein the nutation command signal is generated by:

generating a sinusoidal position signal representing the position of the momentum member relative to a fixed reference and at a frequency representing the rate of rotation of the momentum member; and controlling the frequency of the nutation command signal in response to the position signal.

21. A method for scanning an area of interest in relation to a space stabilized reference axis established by a momentum member rotatably mounted on a support so as to rotate about a spin axis comprising the steps of:

providing a sensor having a line-of-sight and being mounted for movement with the momentum member and with the line-of-sight of the sensor in known relation to the space stabilized reference; and selectively generating a torquer control signal and applying said control signal to a signal responsive means that cooperates with the momentum member to selectively apply torque to the member, said control signal having characteristics causing a controlled nutation of the momentum member such that the spin axis and the sensor line-of-sight move through a desired scan pattern centered about the space stabilized reference.

22. A method for inducing and controlling movement of a gyroscope momentum wheel comprising the steps of:

applying torque to the momentum wheel in a direction that causes precession thereof;

sensing the position of the momentum wheel relative to a reference position;

generating a sinusoidal electrical control signal related to the natural frequency of nutation of the momentum wheel in response to the sensed position;

selectively modulating the amplitude of the control signal; and, controlling the torque applied to the momentum wheel in response to said control signal.

23. A method for inducing and controlling movement of a gyroscope momentum wheel comprising the steps of:

applying torque to the momentum wheel to cause precession and nutation thereof;

sensing the position of the momentum wheel relative to its mounting;

sensing the position of a line-of-sight reference to the momentum wheel by means of received electromagnetic radiation;

generating a precession command signal in response to the sensed position of the line-of-sight;

generating a sinusoidal electrical nutation feedback signal related to the natural nutation frequency of momentum wheel in response to the sensed position of the momentum wheel;

selectively modulating the amplitude of the nutation feedback signal; and, controlling the torque applied to the momentum wheel in response to both the precession command signal and the modulated nutation feedback signal.

24. Apparatus for inducing and controlling movement of a gyroscope momentum wheel comprising:

means for applying torque to the momentum wheel to cause precession and nutation thereof;

means sensing the position of the momentum wheel relative to its mounting;

sensor means for sensing electromagnetic radiation and determining the position of a line-of-sight referenced to the momentum wheel in response to the sensed electromagnetic radiation;

means for generating a precession command signal in response to the position of the line-of-sight;

means for generating a sinusoidal electrical nutation feedback signal related to the natural nutation frequency of momentum wheel in response to the sensed position of the momentum wheel;

means for selectively modulating the amplitude of the nutation feedback signal; and, means controlling the torque applying means to control the torque applied to the momentum wheel in response to both the precession command signal and the modulated nutation feedback signal.

25. The apparatus of claim 24 wherein the torque controlling means includes means for summing the precession command and nutation feedback signals to produce a sum signal, the torque controlling means being responsive to the sum signal.

26. The apparatus of claim 24 wherein the electromagnetic radiation sensing means comprises a sensor for detecting laser energy.

27. In a missile guidance system for scanning a target area and tracking a detected target including a gyroscope having a momentum member rotatably mounted in the nose of a missile to establish a space stabilized reference, the momentum member having a spin axis and being mounted for movement relative to the missile about a pitch axis and a yaw axis, and a sensor having a line-of-sight and being mounted with the line-of-sight in known relation to the spin axis of the momentum member, a scanning and tracking system comprising:

position sensing means for producing electrical signals representative of the position of the momentum member relative to a reference on the missile;

frequency control means responsive to said position signals for producing a sinusoidal drive signal of a frequency integrally related to the natural nutation frequency of the momentum member;

drive signal control means for selectively varying the amplitude of said sinusoidal drive signal in a periodic manner;

signal processing means for receiving said drive signal and tracking error signals from the missile guidance system, said signal processing means for combining said drive signal and said error signals; and torquer means for selectively applying torque to the momentum member in response to the combined drive signal and tracking error signals to cause the momentum member to nutate in a controlled manner responsive to said periodically varying sinusoidal drive control signals producing a desired scan pattern of the sensor and to cause the gyroscope to precess in response to the tracking error signals for maintaining the line-of-sight of the sensor essentially on a detected target.

28. The system of claim 27 in which said position sensing means includes means for producing an electrical signal representing the position of the momentum member in yaw and an electrical signal representative of the position of the momentum member in pitch.

29. The system of claim 28 in which said frequency control means comprises:

a band pass filter having a band width essentially equal to an expected range of variation of the natural nutation frequency of the momentum member, said filter having an input receiving one of said position signals;

comparator means connected to the output of the band pass filter for producing a square wave output having a repetition rate equal to the frequency of said position signal;

phase locked loop means including an analog switch wherein said phase locked loop controls said switch to produce a switched signal at the frequency of the incoming position signal;

second band pass filter means for receiving said switched signal from the analog switch and for extracting the sinusoidal component thereof to produce a yaw nutation drive signal; and a phase shift network for receiving said yaw nutation drive signal and producing a pitch nutation drive signal having a 90° relationship with the yaw nutation drive signal.

30. The system of claim 29 in which said drive signal control means include modulator means receiving an externally-generated nutation amplitude command signal, the modulator adapted to control the peak amplitude of the output signal from the analog switch proportional to the amplitude of the nutation amplitude command signal, whereby the yaw and pitch nutation drive signals vary in peak amplitude in accordance with the nutation amplitude command signal.

31. The system of claim 30 in which the nutation amplitude command signal is of a selected constant value, thereby producing constant pitch and yaw nutation drive signals causing a constant amplitude nutation such that the line-of-sight of the sensor scans in a circular pattern, and whereby the area of said circular pattern is controllable by controlling of such constant nutation amplitude command signal.

32. The system of claim 31 in which said signal processing means comprises:

a pitch 90° phase lead network for receiving the pitch position signal;

a yaw 90° phase lead network for receiving the yaw position signal;

first summing means for receiving the output of the pitch phase lead network, an externally-generated yaw position component of the tracking error signals, the yaw position signal, and the yaw nutation drive signal for summing said signals to produce a yaw drive signal; and second summing means for receiving the output from the yaw phase lead network, an externally-generated pitch position component of the tracking error signals, the pitch position signal, and the pitch nutation drive signal for summing said signals to produce a pitch drive signal.

* * * * *